US010668634B2

(12) United States Patent
Chan

(10) Patent No.: US 10,668,634 B2
(45) Date of Patent: Jun. 2, 2020

(54) OSCILLATING ROTARY SHAVER

(71) Applicant: Conair Corporation, Stamford, CT (US)

(72) Inventor: Hon Hung Joseph Chan, Honk Kong (CN)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 16/139,897

(22) Filed: Sep. 24, 2018

(65) Prior Publication Data

US 2020/0094424 A1 Mar. 26, 2020

(51) Int. Cl.

| | |
|---|---|
| ***B26B 19/12*** | (2006.01) |
| ***B26B 19/14*** | (2006.01) |
| ***B26B 19/28*** | (2006.01) |

(52) U.S. Cl.

CPC ..... *B26B 19/12* (2013.01); *B26B 19/141* (2013.01); *B26B 19/143* (2013.01); *B26B 19/28* (2013.01)

(58) Field of Classification Search

CPC ..... B26B 19/143; B26B 19/12; B26B 19/28; B26B 19/14; B26B 19/141; B23Q 5/341

USPC ..... 74/276, 67

See application file for complete search history.

(56) References Cited

U.S. PATENT DOCUMENTS

| | | | | | |
|---|---|---|---|---|---|
| 3,264,734 | A * | 8/1966 | Starre | B26B 19/42 | 30/43.5 |
| 3,270,360 | A * | 9/1966 | Kropp | F28G 3/04 | 15/22.1 |
| 4,038,747 | A * | 8/1977 | Upton | B26B 19/26 | 30/34.2 |
| 4,694,789 | A * | 9/1987 | Frost | F01L 1/024 | 123/192.2 |
| 5,080,053 | A * | 1/1992 | Parsons | F01L 1/02 | 123/90.15 |
| 6,655,620 | B2 * | 12/2003 | Huat | A01K 89/0114 | 242/242 |
| 9,190,881 | B1 * | 11/2015 | Jahani | H02K 7/06 | |
| 2007/0084059 | A1 * | 4/2007 | Hannan | B26B 19/14 | 30/43.5 |
| 2010/0146791 | A1 * | 6/2010 | Oh | B26B 19/14 | 30/34.1 |
| 2012/0019933 | A1 * | 1/2012 | Nakamura | G02B 7/102 | 359/700 |
| 2014/0157957 | A1 * | 6/2014 | Mimura | B21D 53/64 | 76/116 |
| 2014/0262408 | A1 * | 9/2014 | Woodard | A61B 10/025 | 173/216 |

* cited by examiner

*Primary Examiner* — Andrea L Wellington
*Assistant Examiner* — Fernando A Ayala
(74) *Attorney, Agent, or Firm* — Lawrence Cruz, Esq.; Ryan, Mason & Lewis, LLP

(57) ABSTRACT

A shaver head assembly includes at least one cutting head component having a housing, an inner cutting blade mounted to the housing and configured and adapted to rotate about an axis and an outer cutting disc coaxially mounted about the axis. The outer cutting disc is configured to oscillate about the axis through positive and negative predetermined angular sectors of rotation, and is configured to cooperate with the inner cutting blade to cut hair.

13 Claims, 6 Drawing Sheets

OSCILLATING ROTARY SHAVER

BACKGROUND

1. Technical Field

The present disclosure generally relates to a shaving apparatus, and more particularly, relates to a shaving head assembly for a shaving apparatus incorporating one or more cutting head components each with an oscillating outer cutting disk and an inner cutting blade, which cooperate to enhance the cutting effect on facial hair.

2. Discussion of Related Art

Conventional rotary shavers are known in the art. A conventional rotary shaver includes one or more shaver heads, e.g., three shaver heads, each having an internal rotating cutting blade surrounded by a stationary foil. Although these rotary shavers are generally useful for their intended purposes, they can be improved in their overall effectiveness in cutting or trimming hair. For example, a conventional rotary shaver sometimes requires multiple passes over the face to adequately trim or cut facial hair. In addition, conventional rotary shaver performance can be limited when cutting facial hair that is relatively long in length.

SUMMARY

Accordingly, the present disclosure is directed to an oscillating rotary shaver head assembly. The shaver head assembly includes at least one cutting head component having a housing, an inner cutting blade mounted to the housing and configured and adapted to rotate about an axis, and an outer cutting disc coaxially mounted about the axis. The outer cutting disc is configured to oscillate about the axis through positive and negative predetermined angular sectors of rotation, and is configured to cooperate with the inner cutting blade to cut hair.

In an embodiment, the shaver head assembly includes a blade holder coupled to the inner cutting blade and rotatable to impart rotational movement to the inner cutting blade. The blade holder includes a cam member configured to rotate about the axis to impart oscillating movement of the outer cutting disc through the predetermined positive and negative predetermined angular sectors of rotation.

The shaver head assembly may include a slider coupled to the cam member and to the outer cutting disc. The slider is configured to impart oscillating movement to the outer cutting disc upon rotational movement of the cam member. An oscillator ring may be mounted adjacent the slider and coupled to the outer cutting disc. The oscillator ring has a cam pin engageable with a pair of cam followers of the slider such that movement of the slider causes rotational movement of the oscillator ring and the outer cutting disc through interaction of the cam pin and the cam followers.

The cam member may be configured such that one rotation of the cutting blade results in one complete oscillation cycle of the outer cutting disc.

The positive and negative predetermined angular sectors of rotation of the outer cutting disc may range from between about 4.5 degrees and −4.5 degrees, respectively, relative to a zero-degree reference.

The outer cutting disc may include a central pocket in general alignment with the axis with the central pocket being configured to accommodate hair. The outer cutting disc further may include at least one set of comb guides depending radially inwardly toward the axis and surrounding the pocket. The comb guides are configured to impart a combing effect on hair (e.g., facial hair) to facilitate cutting by the inner cutting blade and the outer cutting disc. Three sets of comb guides spaced about the pocket may be provided.

The shaver head apparatus may include three cutting head components.

Other features of the present disclosure will be appreciated from the following description of same.

DETAILED DESCRIPTION

Figure 1:
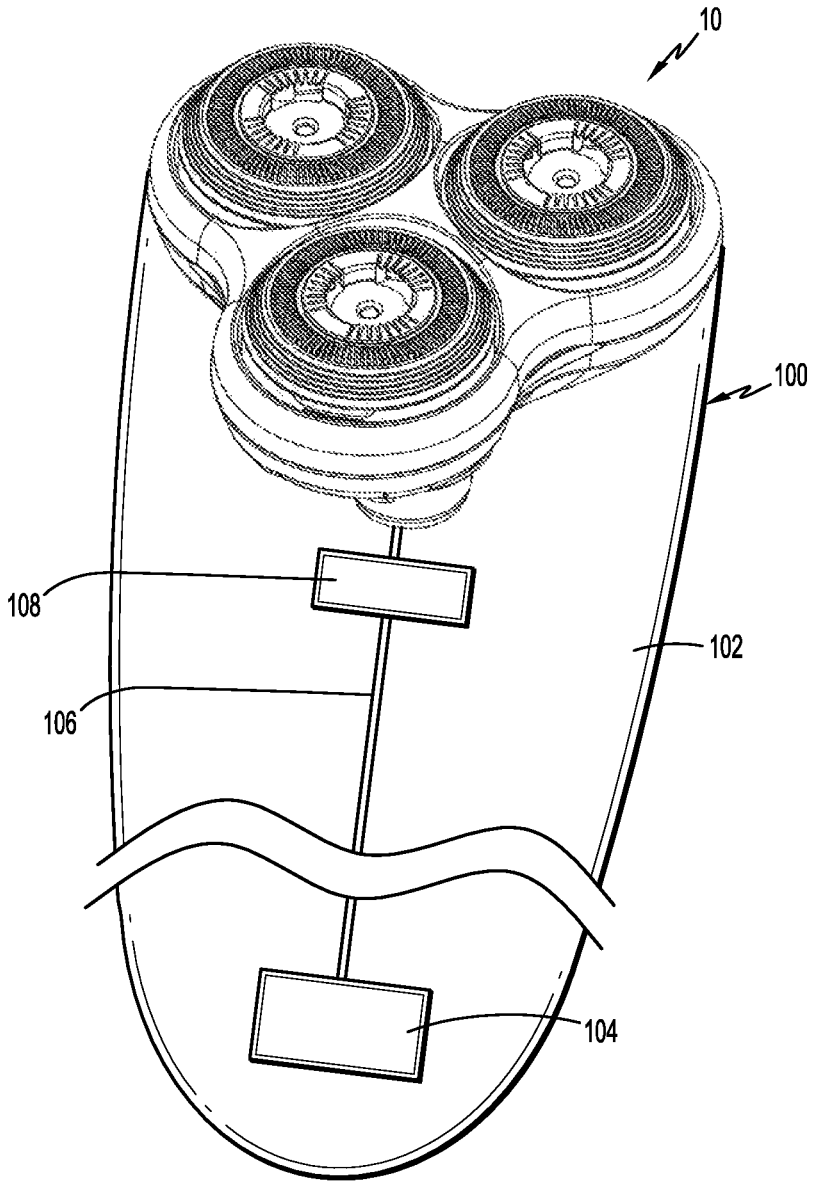
FIG. 1 is a perspective view of a shaving apparatus incorporating the shaving head assembly in accordance with the principles of the present disclosure.

Referring now to the drawings where like reference numerals identify equivalent or similar components throughout the several views, FIG. 1 illustrates the shaver head assembly in accordance with the principles of the present disclosure. The shaver head assembly 10 may be a component of a shaver apparatus 100 of the type including a handle or frame 102, a motor 104 (shown schematically) and a rotatable drive shaft 106 (shown schematically) coupled to the motor 104. The shaver apparatus 100 may include a gear system such as a planetary gear mechanism, identified schematically as reference numeral 108, to impart rotational movement of the drive shaft 106 to one or more shaver head components associated with the shaver head assembly 10. Such gear systems are known in the art. One example of a suitable gear system for imparting motion to a plurality of cutting elements of a shaver apparatus is disclosed in U.S. Pat. No. 5,983,501 to Izumi, the entire contents of which are hereby incorporated by reference herein.

Figure 2:
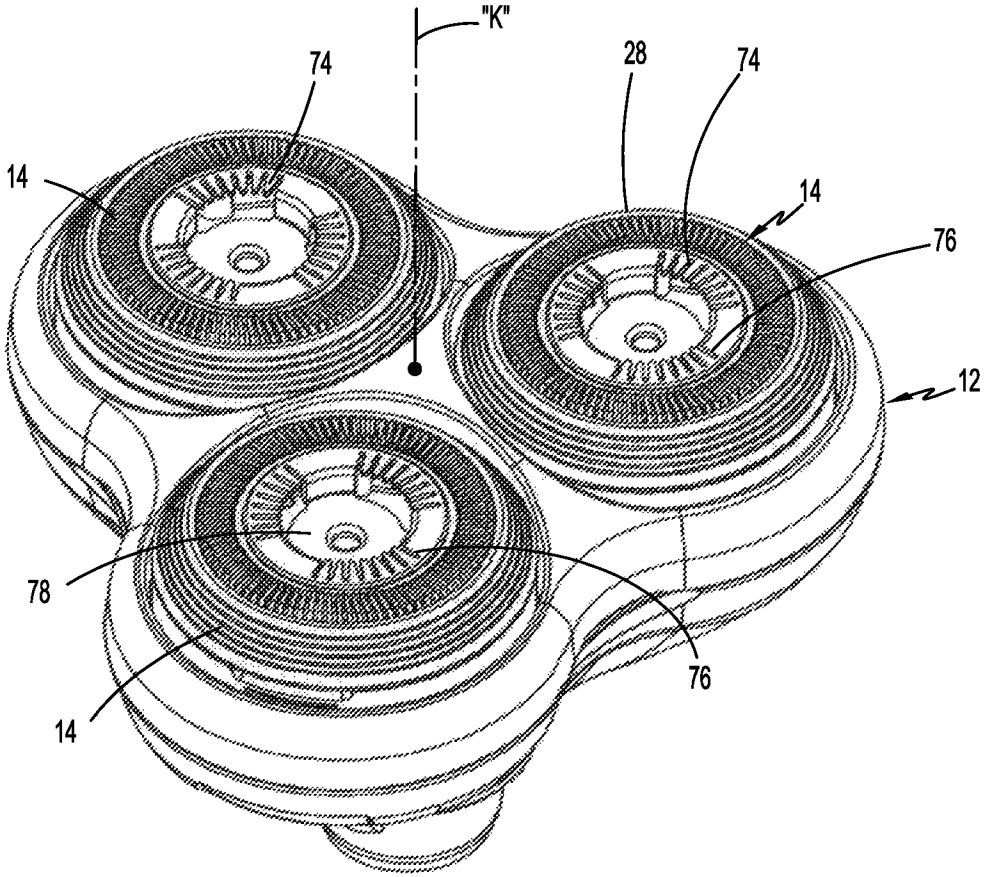
FIG. 2 is an enlarged perspective view of the shaving head assembly.

Referring now to FIG. 2, the shaver head assembly 10 includes a housing 12 defining a central axis "k" and one or more shaver head components 14, e.g., three shaver head components, supported by the housing 12. The shaver head components 14 may be spaced about the central axis "k." As will be discussed in detail hereinbelow, each shaver head component 14 incorporates rotational and oscillatory moveable elements which cooperate to trim, cut and/or remove hair from the body, particularly, the face of the subject. The shaver head components 14 may be identical in structure and function.

Figure 3:
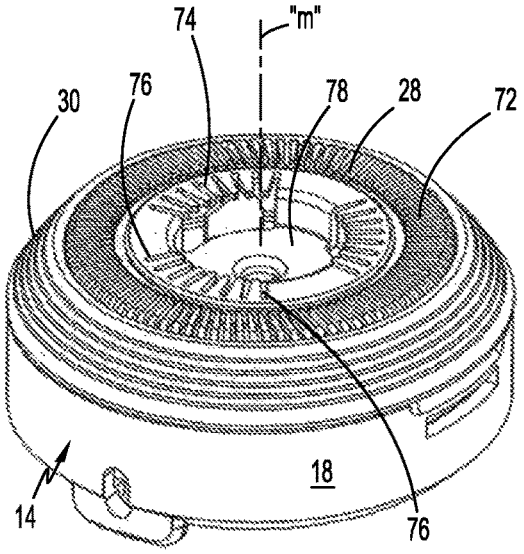
FIG. 3 is a perspective view of a single cutting head component of the shaving head assembly.
Figure 4:
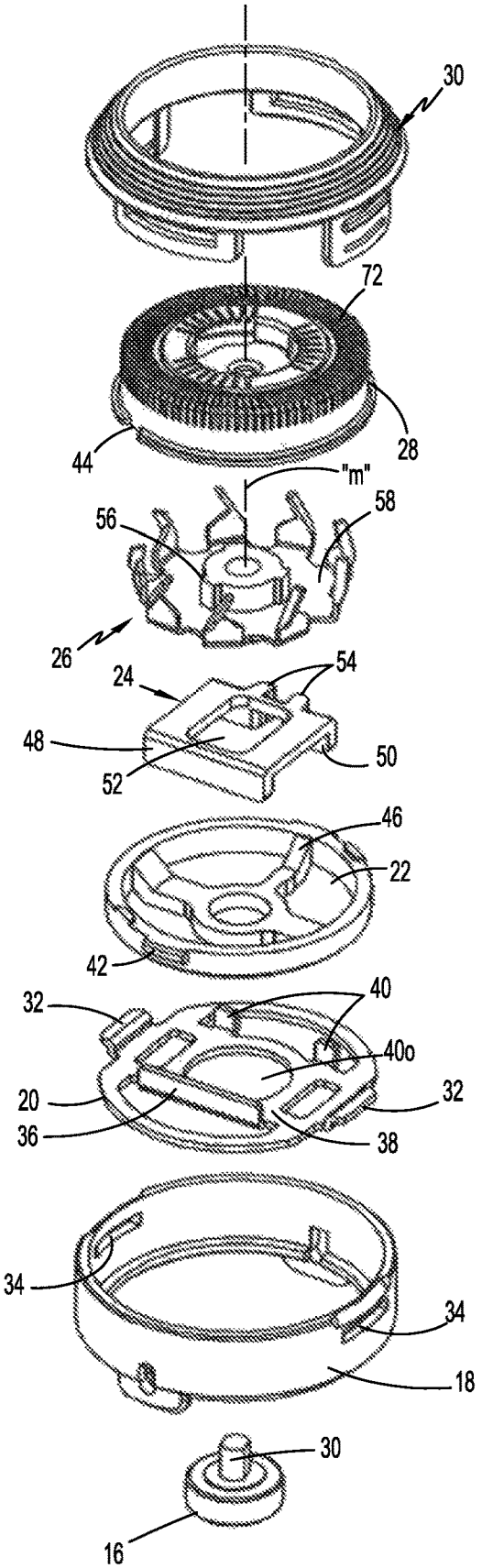
FIG. 4 is an exploded perspective view of the single cutting head component illustrating the elements thereof.

FIG. 3 is a perspective view of a single shaver head component 14 of the shaver head assembly 10 and FIG. 4 is an exploded perspective view of the single head component 14. Each head component 14 includes, from bottom to top, a joint coupler 16, a lower casing 18, a bracket railing 20, an oscillator ring 22, a slider 24, an inner cutting blade 26, an outer cutting disc 28 and an upper casing 30. In general, these components cooperate to cause rotational movement of the inner cutting blade 26 about a rotation axis "m" of the head component 14 and oscillatory movement of the outer cutting disc 28 through predetermined angular sectors of rotational movement.

Referring still to FIGS. 3-4, the joint coupler 16 is configured to couple with the planetary gear system 108 of the shaving apparatus 100 to impart movement to the elements of the respective head component 14. The joint coupler 16 includes a central drive pin 30 having a rectangular or otherwise non-circular cross-section. The bracket railing 20 is secured within the lower casing 18 in fixed relation therewith. In one embodiment, the bracket railing 20 includes a pair of tabs 32 which are received within corresponding openings 34 in the lower casing 18 in snap relation therewith to secure the two elements. The bracket railing 20 includes a first retaining wall 36 depending upwardly from the base 38 of the bracket railing 20, and a pair of retaining tabs 40 opposing the retaining wall 36. The retaining wall 36 and the retaining tabs 40 cooperate with corresponding structure of the slider 24 to ensure the slider 24 moves in a linear direction as will be discussed hereinbelow. The bracket railing 20 further includes a central opening 40*o*.

The oscillator ring 22 is coupled to the outer cutting disc 28 whereby oscillatory movement of the oscillator ring 22 relative to the rotation axis "m" causes corresponding oscillatory movement of the outer cutting disc 28. Any methodology for coupling the oscillator ring 22 and the outer cutting disc 28 is envisioned. In one embodiment, the oscillator ring 22 includes at least one or more peripheral tabs 42 which are received within correspondingly dimensioned tab slots 44 of the outer cutting disc 28 to couple the components. The oscillator ring 22 also includes a cam pin 46 depending radially inwardly relative to the rotation axis "m' of the head component 14. The cam pin 46 is resilient and normally biased to the straight orientation depicted in FIG. 4.

The slider 24 includes two slider retention walls 48, 50 one of which is a continuous wall and the other which is segmented. The slider retention walls 48, 50 cooperate with the retaining wall 36 and the retaining tabs 40 of the bracket railing 20 to couple the components in a manner permitting linear sliding movement of the slider 24 relative to the bracket railing 20. In particular, the slider 24 may only move linearly in either direction, e.g., reciprocal movement, and is retained from rotating due to the engagement and interaction of the retaining walls 36 and the retaining tabs 40 of the bracket railing 20 and the slider retention walls 48, 50 of the slider 24. The slider 24 defines an inner recess 52 which may be rectangular in configuration. The slider 24 further includes a pair of spaced cam followers 54 depending outwardly from the exterior of the slider 24. The cam followers 54 of the slider 24 receive the cam pin 46 of the oscillator ring 22.

Figure 5:
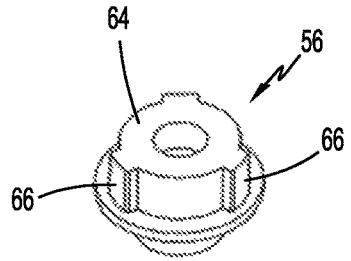
FIGS. 5-6 are perspective views of the blade holder of the single cutting head component.
Figure 6:
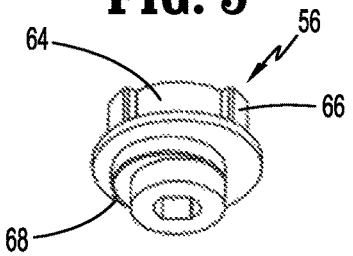
Figure 8:
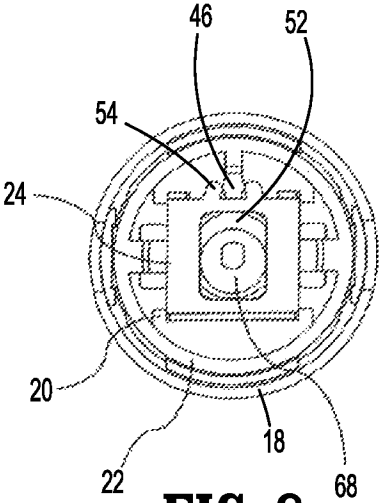
FIG. 8 is a top plan view with the inner blade member, the outer cutting ring and the upper casing each being removed to illustrate the relationship of the blade holder, the oscillating ring, and the slider.
Figure 7:
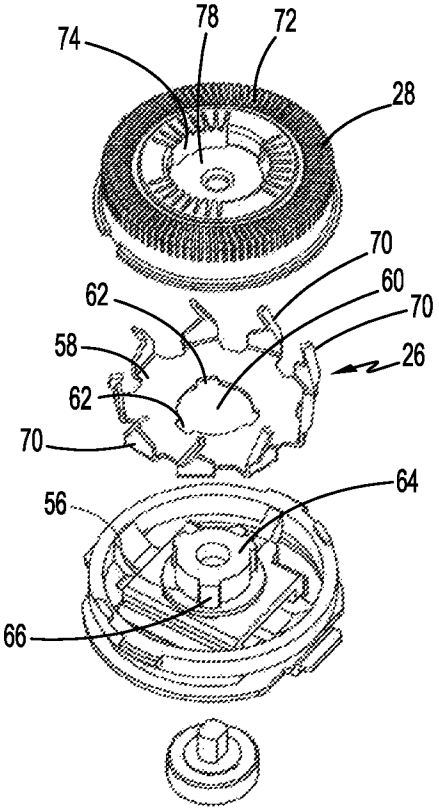
FIG. 7 is an exploded perspective view illustrating the relationship of the outer cutting ring, the inner cutting blade, the blade holder and the joint coupler of the single cutting head component.

Referring now to FIGS. 4-7, the shaver head component 14 further includes a blade holder 56 to which the inner cutting blade 26 is coupled. In one embodiment, the inner cutting blade 26 includes an inner blade plate 58 defining a central aperture 60 with three spaced grooves 62 (FIG. 7). The blade holder 56 includes a circular head 64 for reception within the central aperture 60 of the inner cutting blade 26 (FIG. 7) and three splines 66 correspondingly dimensioned to be received within the spaced grooves 62 of the inner cutting blade 26. (FIGS. 5-7). With this arrangement, rotation of the blade holder 56 will cause corresponding rotation of the inner cutting blade 26. As best depicted in FIG. 6, the blade holder 56 includes a lower cam component 68 depending radially outwardly relative to the central axis "m". The lower cam component 68 is asymmetrical in configuration and is received within the inner recess 52 of the slider 24. (FIG. 8). Thus, rotation of the blade holder 56 will cause the slider 24 to oscillate due to engagement of the lower cam component 68 with the inner edges 24 of the slider 24 defining the inner recess 52 as will be discussed in greater detail hereinbelow.

As best depicted in FIG. 7, the inner cutting blade 26 includes a plurality of peripheral blades 70 depending upwardly from the inner blade plate 58. The peripheral blades 70 may include sharp edges on each side configured to trim hair.

As best depicted in FIG. 7, in conjunction with FIG. 3, the outer cutting disc 28 includes a plurality of peripheral cutting blades foils 72. The cutting blade foils 72 are each dimensioned to cut hair in either direction and may operate in concert with the inner cutting blade 26 to trim hair. The cutting blade foils 72 are relatively flexibly mounted to follow the contours of the face and to be firmly pressed against the skin during the shaving process. Depending inwardly from the cutting blade foils 72 is at least one, e.g., three sets of comb guides 74, equidistantly spaced about the rotation axis "m" of the head component 14. The comb guides 74 include longitudinal slots 76 dimensioned to untangle or straighten hair to be cut, particularly, long facial hair, during the shaving process. (FIG. 3). The outer cutting disc 28 also includes a central pocket 78 inward of the comb guides 74. The central pocket 78 is configured to accommodate the relatively long hair which is straightened by the comb guides 74 to orient the hair in a somewhat linear manner to facilitate cutting same. The central pocket 78 may also receive cut segments of the hair.

The upper casing 30 encloses the elements of the shaver head component 14. The upper casing 30 may be secured to the lower casing 18 via conventional methodologies including a tongue and groove arrangement, tab/slot arrangement, bayonet coupling, adhesives or the like.

Figure 9:
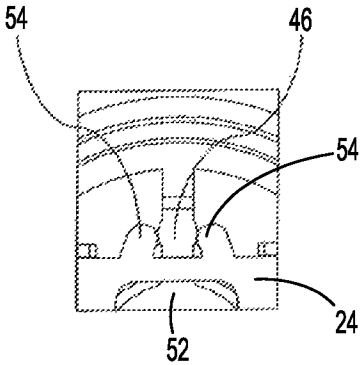
FIG. 9 is an enlarged isolated view illustrating the interrelationship of the cam mechanism of the oscillator ring and the slider.

FIG. 8 is a top plan view with the inner cutting blade 26, the outer cutting disc 28 and the upper casing 30 each removed illustrating the relationship of the blade holder 56, the oscillator ring 22, and the slider 24. In FIG. 8, the upper half of the blade holder 56 is removed to depict the lower cam component 68 oriented within the recess 52 of the slider 24 (FIG. 6). Also depicted in FIGS. 8-9 is the cam pin 46 of the oscillator ring 22 within the spaced cam followers 54 of the slider 24.

Figure 10:
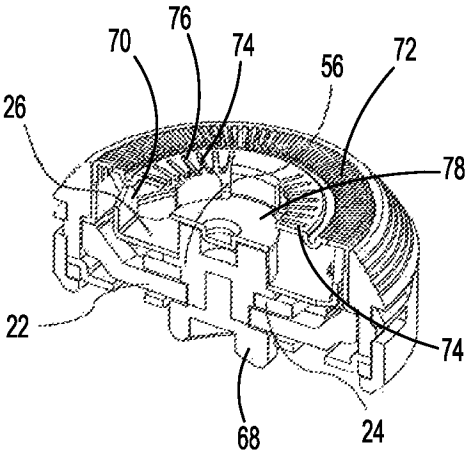
FIG. 10 is a perspective view in partial cross-section of the single cutting head component illustrating the outer cutting disk, the oscillator ring and the inner cutting blade.

FIG. 10 is a cross-sectional view illustrating the interrelationships of the elements of the single shaver head component 14. As shown, the oscillator ring 22 and the slider 24 are depicted coaxially positioned about the blade holder 56. The inner cutting blade 26 is also coupled to the blade holder 56 with the peripheral blades 70 depicted adjacent the peripheral cutting blades foils 72 of the outer cutting disc 28. The peripheral blades 70 are also disposed generally at the intersection of the comb guides 74 and the outer cutting blade foils 72. The positioning of the peripheral blades 70 at this location will facilitate trimming of the hair supported within the longitudinal slots 76 of the comb guides 74.

Figure 11A:
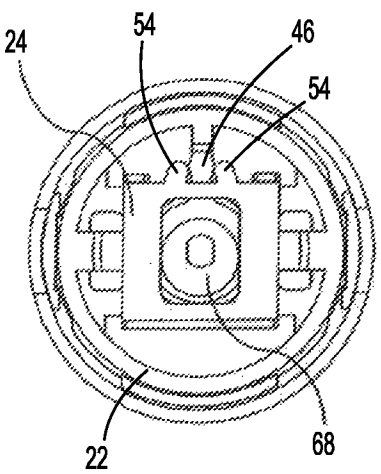
FIGS. 11A-11D are views illustrating a sequence of movement of the slider and the oscillator ring to cause oscillation of the outer cutting disk through predetermined angle sectors of rotation.
Figure 11B:
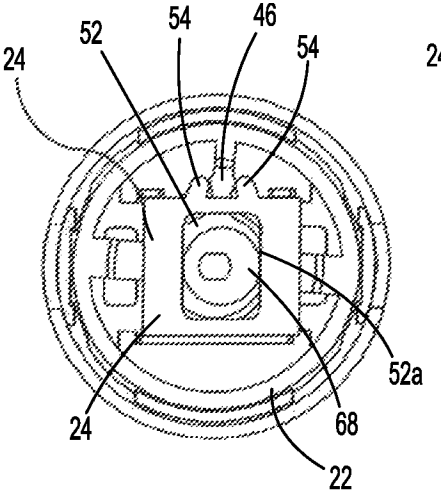
Figure 11C:
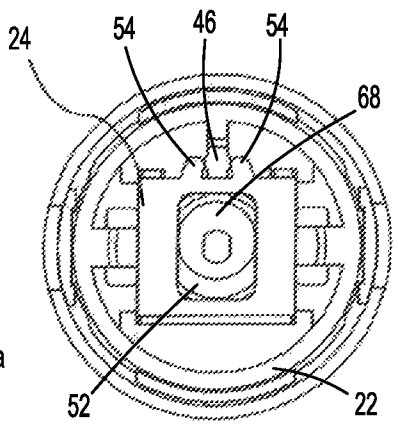
Figure 11D:
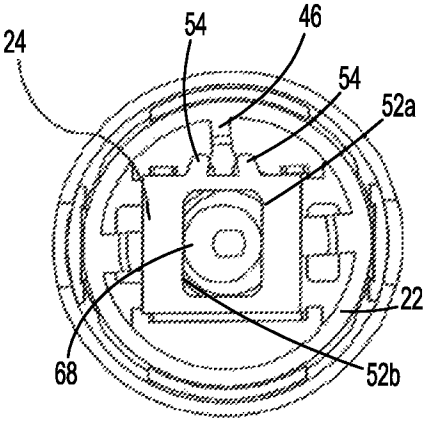
Figure 12:
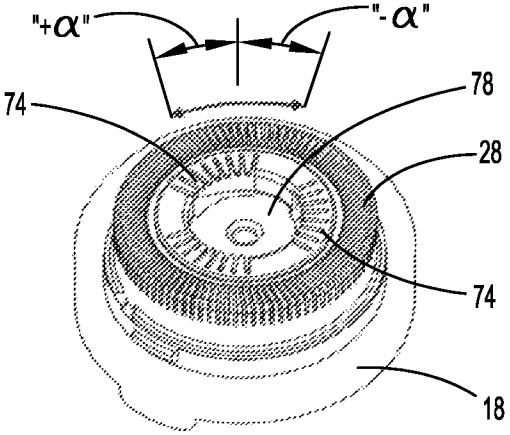
FIG. 12 is a perspective view of the single cutting head component with the upper casing removed to illustrate the oscillating movement of the outer cutting disc.

FIGS. 11A-11D illustrate a sequence of operation of a single cutting head component 14 of the shaver head assembly 10. The views of FIGS. 11A-11D are consistent with the view of FIG. 8 discussed hereinabove. Upon activation of the shaver apparatus 100, rotatable movement is translated from the motor 104 to each head component 14 via joint coupler 16. The joint coupler 16 will cause the blade holder 56 to rotate to cause the inner cutting blade 26 to rotate in a continuous manner. However, while the blade holder 56 rotates, the lower cam component 68 of the blade holder 56 will also rotate within the inner recess 52 of the slider 24. More specifically, in FIG. 11A, the lower cam component 68 of the blade holder 56 is in a neutral position. Upon continued rotation of the blade holder 56, the lower cam component 68 engages the side 52*a* of the inner recess 52 of the slider 24 to displace the slider 24 a predetermined distance in one direction (e.g., to the right in FIG. 11B). This movement also causes the cam followers 54 of the slider 24 to engage the cam pin 46 of the oscillator ring 22 and move (e.g., rotate) the oscillator ring 22 through a predetermined angular sector of rotation relative to the head axis "m" of the head component 14. This rotational movement also effects corresponding rotational movement of the outer cutting disc 28 indexed to the oscillator ring 22. Continued rotation of the blade holder 56 will position the lower cam component 68 in a second neutral position with the lower cam component 68 disengaged from any edge within the inner recess 52 of the slider 24 as depicted in FIG. 11C. Thus, the oscillator ring 22 returns to a neutral position in response to the bias of the cam pin 46 on the cam followers 54. Further rotational movement of the blade holder 56 causes the lower cam component 68 to engage the side 52*b* of the inner recess 52 opposite side 52*a* as shown in FIG. 11D thereby displacing the slider 24 a predetermined distance in the opposite direction while also causing the oscillator ring 22 and the outer cutting ring 28 to rotate through a predetermined angular sector of rotation in the opposite direction. Thus, each complete revolution of the blade holder 56 will cause the slider 24 to reciprocate from a first neutral position (FIG. 11A) to a first displaced position in one direction (FIG. 11B), then to a second neutral position (FIG. 11C), and then to a second displaced position in a second direction (FIG. 11D), and then return to its first neutral position (FIG. 11A) to complete the oscillation cycle. Otherwise stated, one rotation of the blade holder 56 and (thus, the inner cutting blade 26) results in one complete oscillation cycle of the oscillator ring 22 and the outer cutting disc 28. In one embodiment depicted in FIG. 12, the outer cutting ring 28 oscillates through positive and negative predetermined angular sectors of rotation "+α", "−α" relative to a zero 0 degree. The values of the of predetermined angular sectors of rotation "+α", "−α" may vary. In one embodiment, the predetermined angular sectors of rotation "+α", "−α" range from between about 4.5 degrees and −4.5 degrees, respectively, relative to the zero-degree reference, for a total of 9 degrees of movement. To achieve this rotational movement the slider 24 may move about 0.5 mm in both directions. Other angular movement ranges are also envisioned.

One rotation of the blade holder and the inner cutting blade corresponds to one oscillation cycle of the outer blade. In one exemplary embodiment, the inner cutting blade 26 may be set to rotate at 3000 revolutions per minute thereby causing the outer cutting disc 28 to oscillate at 3000 cycles per minute. But since the angular movement of the outer cutting disc 28 is only 9 degrees, the angular velocity of the outer cutting disc 28 is slower than the inner cutting blade 26 when they move in the same direction. The inner cutting blade 26 completes 180 degrees of rotation to move the outer cutting disc 28 through 9 degrees of rotation at the same direction and at the same rate which indicates the outer cutting disc 28 moves 20× slower than that of the inner cutting blade 26. Thus, if the inner cutting blade 26 rotates in one direction at an angular velocity of 3000 rpm, the angular velocity of the oscillation of the outer cutting disc 28 is equivalent to the angular velocity of an object rotating at about 150 rpm.

Figure 14:
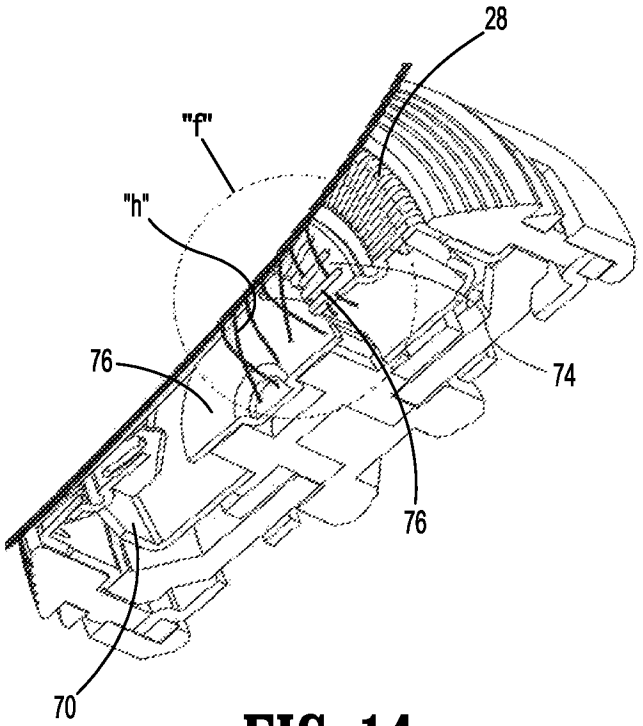
FIGS. 13-14 are views illustrating use of the shaver head assembly in trimming facial hair.
Figure 13:
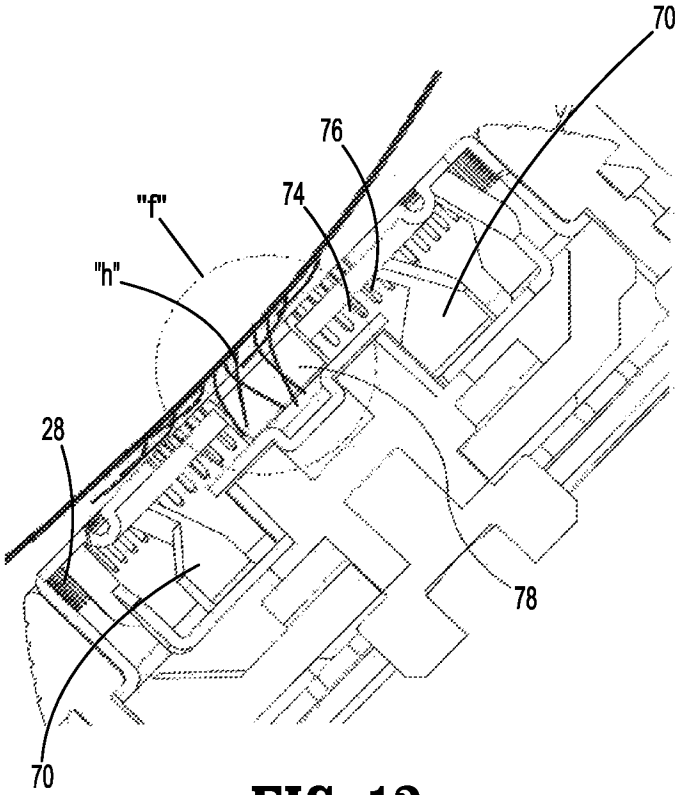

FIGS. 13-14 illustrate use of the shaver head assembly 10 in trimming or cutting facial hair. As shown, actuation of the shaver head assembly 10 causes corresponding rotation of the inner cutting blade 26 and oscillation of the outer cutting disc 28. The combined movement of the components effects a smooth and nonabrasive cutting action on the face "f". The oscillation of the outer cutting disc 28 in combination with the comb guides 74 untangles the facial hair whereby the strands "h" are readily captured in the slots 76 of the comb guides 74. Due to the dynamic movement of the outer cutting disc 28, the slots 76 of the comb guides 74 can leverage and align with the wave pattern of the hair strands "h" to entrap the strands and support the strands "h" for cutting by either the inner cutting blade 26 or the outer cutting disc 28. Moreover, the central pocket 78 accommodates longer hair strands "h" while the oscillating cutting action untangles the hair and draws the strands "h" in the slots 76 of the comb guides 74 for easier and more effective cutting. The slots 76 of the comb guides 74 support the hair strands "h" upwardly to improve the cutting action of the inner cutting blade 26 and the outer cutting disc 28. Also, the peripheral blades 70 of the inner cutting blade 26 are aligned with the slots 76 (i.e., where the slots 76 begin) such that the hair "h" supported by slots are directly engaged by the peripheral blades 70.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. An oscillating rotary shaver head assembly, which comprises:

at least one cutting head component, including:

a housing;

an inner cutting blade mounted to the housing, the inner cutting blade configured and adapted to rotate about an axis;

an outer cutting disc coaxially mounted about the axis, the outer cutting disc configured to oscillate back and forth relative to the axis, and configured to cooperate with the inner cutting blade to cut hair;

a blade holder coupled to the inner cutting blade and rotatable to impart rotational movement to the inner cutting blade, the blade holder including a cam member, the cam member configured to rotate about the axis to impart oscillating movement of the outer cutting disc;

a slider coupled to the outer cutting disc, the slider configured to impart oscillating movement to the outer cutting disc upon rotational movement of the cam member; and an oscillator ring mounted adjacent the slider and coupled to the outer cutting disc, the oscillator ring having a cam pin engageable with a pair of cam followers of the slider such that movement of the slider causes rotational movement of the oscillator ring and the outer cutting disc through interaction of the cam pin and the cam followers.

2. The shaver head assembly according to claim 1 wherein the cam member is configured such that one rotation of the cutting blade results in one complete oscillation cycle of the outer cutting disc.

3. The shaver head assembly according to claim 1 wherein the outer cutting disc is coaxially mounted about the axis, the outer cutting disc configured to oscillate back and forth about the axis through positive and negative predetermined angular sectors of rotation, the positive and negative predetermined angular sectors of rotation being about 4.5 degrees and −4.5 degrees, respectively, relative to a zero-degree reference.

4. The shaver head assembly according to claim 1 wherein the outer cutting disc includes a central pocket in general alignment with the axis, the central pocket configured to accommodate hair.

5. The shaver head assembly according to claim 4 wherein the outer cutting disc includes at least one set of comb guides depending radially inwardly toward the axis and surrounding the pocket, the comb guides configured to impart a combing effect on facial hair to facilitate cutting by the inner cutting blade and the outer cutting disc.

6. The shaver head assembly according to claim 5 wherein the outer cutting disc includes three sets of comb guides spaced about the pocket.

7. The shaver head assembly according to claim 6 including three cutting head components.

8. An oscillating rotary shaver head assembly, which comprises:

at least one cutting head component, including:

a housing;

an inner cutting member mounted to the housing, the inner cutting member configured and adapted to rotate about a central rotational axis;

a motor coupled to the inner cutting member to cause the inner cutting member to rotate about the central rotational axis;

an outer cutting member coaxially mounted about the central rotational axis, the outer cutting member including cutting foils and configured to cooperate with the inner cutting member to cut hair, the outer cutting member defining a recessed central pocket radially inward of, and spaced from, the cutting foils, the outer cutting member configured to oscillate back and forth about the central longitudinal axis;

a blade holder coupled to the inner cutting member and rotatable to impart rotational movement to the inner cutting member, the blade holder including a cam member, the cam member configured to rotate about the axis to impart oscillating movement of the outer cutting member;

a slider coupled to the outer cutting member, the slider configured to impart oscillating movement to the outer cutting member upon rotational movement of the cam member; and an oscillator ring mounted adjacent the slider and coupled to the outer cutting disc, the oscillator ring having a cam pin engageable with a pair of cam followers of the slider such that movement of the slider causes rotational movement of the oscillator ring and the outer cutting disc through interaction of the cam pin and the cam followers; and one or more sets of comb guides disposed adjacent the pocket, the one or more comb guides including slots radially inward of, and spaced from, the cutting foils of the outer cutting member configured to impart a combing effect on hair entering the pocket to facilitate cutting by the inner cutting member and the cutting foils of the outer cutting member.

9. The shaver head assembly according to claim 8 including three sets of comb guides spaced about the pocket, each set of comb guides including comb slots, the comb slots each radially inward of, and spaced from, the cutting foils of the outer cutting member.

10. The shaver head assembly according to claim 1 wherein the outer cutting disc including cutting foils configured to cooperate with the inner cutting blade to cut hair.

11. The shaver head assembly according to claim 8 including three cutting head components.

12. The shaver head assembly according to claim 8 wherein the outer cutting member is coaxially mounted about the axis, the outer cutting member configured to oscillate back and forth about the axis through positive and negative predetermined angular sectors of rotation, the positive and negative predetermined angular sectors of rotation being about 4.5 degrees and −4.5 degrees, respectively, relative to a zero-degree reference.

13. The shaver head assembly according to claim 8 wherein the cam member is configured such that one rotation of the cutting blade results in one complete oscillation cycle of the outer cutting member.

* * * * *